US009212621B2

(12) United States Patent
McMurray et al.

(10) Patent No.: US 9,212,621 B2
(45) Date of Patent: Dec. 15, 2015

(54) PISTON AND METHOD OF CONSTRUCTION THEREOF

(71) Applicant: Federal Mogul Corporation, Southfield, MI (US)

(72) Inventors: Mark McMurray, Toledo, OH (US); Marc Brandt, Walled Lake, MI (US)

(73) Assignee: Federal-Mogul Corporation, Southfield, MI (US)

( * ) Notice: Subject to any disclaimer, the term of this patent is extended or adjusted under 35 U.S.C. 154(b) by 0 days.

(21) Appl. No.: 14/209,201

(22) Filed: Mar. 13, 2014

(65) Prior Publication Data

US 2014/0261284 A1 Sep. 18, 2014

Related U.S. Application Data

(60) Provisional application No. 61/780,653, filed on Mar. 13, 2013.

(51) Int. Cl.
*F02F 3/00* (2006.01)

(52) U.S. Cl.
CPC ..... *F02F 3/003* (2013.01); *F02F 2003/0061* (2013.01); *Y10T 29/49252* (2015.01)

(58) Field of Classification Search
USPC ..... 123/193.6, 193.4, 269; 92/189, 190, 92/213, 222, 239; 29/888.042
See application file for complete search history.

(56) References Cited

U.S. PATENT DOCUMENTS

| | | | | |
|---|---|---|---|---|
| 1,362,313 | A * | 12/1920 | Hollister | 92/224 |
| 1,436,922 | A | 11/1922 | Thiede | |
| 1,471,743 | A | 10/1923 | Legate | |
| 1,482,778 | A | 2/1924 | Bowmar | |
| 1,490,849 | A | 4/1924 | Philip | |
| 2,041,113 | A * | 5/1936 | Campbell | 92/213 |
| 2,194,097 | A | 3/1940 | Reggio | |
| 4,253,430 | A | 3/1981 | Garter et al. | |
| 4,270,494 | A | 6/1981 | Garter et al. | |
| 4,531,502 | A | 7/1985 | Mizuhara | |
| 5,014,604 | A | 5/1991 | Hirao et al. | |
| 6,170,454 | B1 | 1/2001 | McFarland et al. | |
| 6,260,472 | B1 | 7/2001 | Zhu et al. | |

(Continued)

FOREIGN PATENT DOCUMENTS

| | | | | |
|---|---|---|---|---|
| DE | 19901770 A1 * | 7/1999 | | F02F 3/04 |
| GB | 2092709 A | 8/1982 | | |

(Continued)

OTHER PUBLICATIONS

International search report mailed Jun. 12, 2014 (PCT/US2014/025536).

*Primary Examiner* — Hung Q Nguyen

(74) *Attorney, Agent, or Firm* — Robert L. Stearns; Dickinson Wright, PLLC

(57) ABSTRACT

A piston and method of construction are provided. The piston has a piston body with an insert forming at least a portion of an upper combustion surface. The piston body is constructed from a first material having a first thermal conductivity and the insert is constructed from a second material having a second thermal conductivity. The first thermal conductivity is less than the second thermal conductivity. The piston body has an upper crown and a pair of pin bosses depending from the upper crown with the pin bosses presenting pin bores aligned with one another along a pin bore axis. The upper crown includes a recess in which the insert is fixed.

21 Claims, 4 Drawing Sheets

(56) References Cited

U.S. PATENT DOCUMENTS

| | | | | |
|---|---|---|---|---|
| 6,371,061 | B2 | 4/2002 | Lash | |
| 6,668,703 | B2 * | 12/2003 | Gamble | 92/186 |
| 6,892,689 | B2 | 5/2005 | Bischofberger et al. | |
| 7,464,684 | B2 | 12/2008 | Scharp et al. | |
| 7,584,694 | B2 | 9/2009 | Scharp | |
| 7,654,240 | B2 | 2/2010 | Jarrett et al. | |
| 2004/0045515 | A1 | 3/2004 | Bischofberger | |
| 2008/0121102 | A1 | 5/2008 | Scharp et al. | |
| 2009/0173309 | A1 | 7/2009 | Ottiliczky et al. | |
| 2011/0030214 | A1 | 2/2011 | Rein | |
| 2011/0119914 | A1 | 5/2011 | Janssen et al. | |
| 2011/0155091 | A1 | 6/2011 | Kollotzek et al. | |
| 2012/0097125 | A1 | 4/2012 | Doss | |
| 2012/0312271 | A1 | 12/2012 | Laimboeck | |
| 2013/0014722 | A1 | 1/2013 | Scharp et al. | |
| 2013/0014723 | A1 | 1/2013 | Bucher | |
| 2013/0014724 | A1 | 1/2013 | Bischofberger | |
| 2013/0047948 | A1 | 2/2013 | Heuschmann | |

FOREIGN PATENT DOCUMENTS

| | | | | |
|---|---|---|---|---|
| GB | 2375724 A | * | 11/2002 | B23P 15/10 |
| JP | 63256287 A | * | 10/1988 | B23K 20/12 |
| JP | 1-262353 | | 10/1989 | |
| WO | 8502804 A1 | | 7/1985 | |

* cited by examiner

PISTON AND METHOD OF CONSTRUCTION THEREOF

CROSS-REFERENCE TO RELATED APPLICATION

This application claims the benefit of U.S. Provisional Application Ser. No. 61/780,653, filed Mar. 13, 2013, which is incorporated herein by reference in its entirety.

BACKGROUND OF THE INVENTION

1. Technical Field

This invention relates generally to internal combustion engines, and more particularly to pistons and to their method of construction.

2. Related Art

Engine manufacturers are encountering increasing demands to improve engine efficiencies and performance, including, but not limited to, improving fuel economy, improving fuel combustion, reducing oil consumption, and increasing the exhaust temperature for subsequent use of the heat within the vehicle. In order to achieve these goals, the engine running temperature in the combustion chamber needs to be increased. However, while desirable to increase the temperature within the combustion chamber, it remains necessary to maintain the piston at a workable temperature; allow the piston to maintained desired low friction clearances within a cylinder bore, while also facilitating the ability of the piston to transfer and dissipate heat, particularly in an upper crown region of the piston.

SUMMARY OF THE INVENTION

In accordance with one aspect of the invention, a piston having a piston body with an insert forming at least a portion of an upper combustion surface is provided. The piston body is formed from a first material having a first thermal conductivity, and includes an upper crown and a pair of pin bosses depending from the upper crown with the pin bosses presenting pin bores aligned with one another along a pin bore axis. The upper crown includes a recess in which the insert is fixed. The insert is formed from a second material separate from the first material of the piston body. The second material has a second thermal conductivity that is higher than the first conductivity of the first material.

In accordance with another aspect of the invention, the insert forms about 95 percent of the upper combustion surface.

In accordance with another aspect of the invention, the insert forms a substantially planar upper combustion surface.

In accordance with another aspect of the invention, a radially outermost periphery of the upper combustion surface is formed by an outer periphery of the piston body upper crown.

In accordance with another aspect of the invention, the recess forms a substantially open cavity that extends along a longitudinal axis through the piston body with at least one web of the piston body extending across the cavity for abutting support with an underside of the insert.

In accordance with another aspect of the invention, the recess forms an annular recessed shoulder encircling the at least one web, wherein the annular shoulder and the at least one web form a planar support surface in abutment with the underside of the insert.

In accordance with another aspect of the invention, the first material can be provided as steel.

In accordance with another aspect of the invention, the second material can be provided as aluminum.

In accordance with another aspect of the invention, a method of constructing a piston for an internal combustion engine is provided. The method includes providing a piston body constructed from a first material having a first thermal conductivity, with the piston body having a pair of pin bosses depending from an upper crown with pin bores aligned with one another along a pin bore axis, the upper crown having a recess. Further, providing an insert constructed from a second material having a second thermal conductivity that is greater than the first thermal conductivity of the piston body. Further yet, fixing the insert in the recess with the insert forming at least a portion of the upper combustion surface of the piston.

The method can further include providing at least one web extending across the substantially open cavity and fixing the aluminum insert in abutment with the at least one web.

The method can further include forming at least one ring groove in the piston body.

The method can further include disposing the insert in substantially flush, planar relation with an outer periphery of the piston body so that the outer periphery of the piston body forms a radially outermost periphery of the upper combustion surface.

The method can further include providing a plurality of the webs, with at least some of the webs intersecting one another.

The method can further include providing the first material as steel.

The method can further include providing the second material as aluminum.

The method can further include forming between about 50-100 percent of the upper combustion surface with the insert.

BRIEF DESCRIPTION OF THE DRAWINGS

These and other aspects, features and advantages of the invention will become more readily appreciated when considered in connection with the following detailed description of presently preferred embodiments and best mode, appended claims and accompanying drawings, in which:

DETAILED DESCRIPTION OF PRESENTLY PREFERRED EMBODIMENTS

Figure 1:
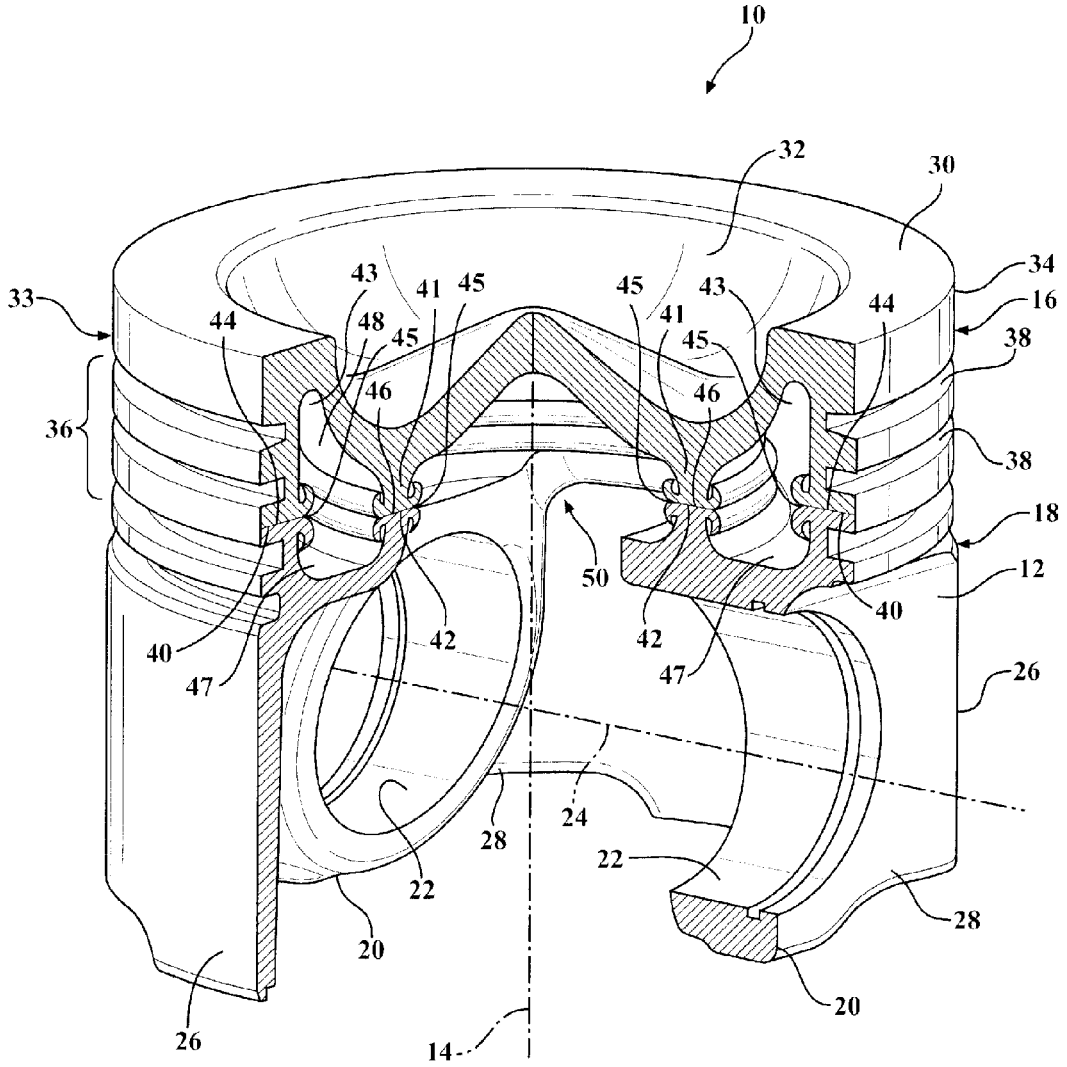
FIG. 1 is a partially sectioned perspective view of a piston constructed in accordance with one aspect of the invention.
Figure 2:
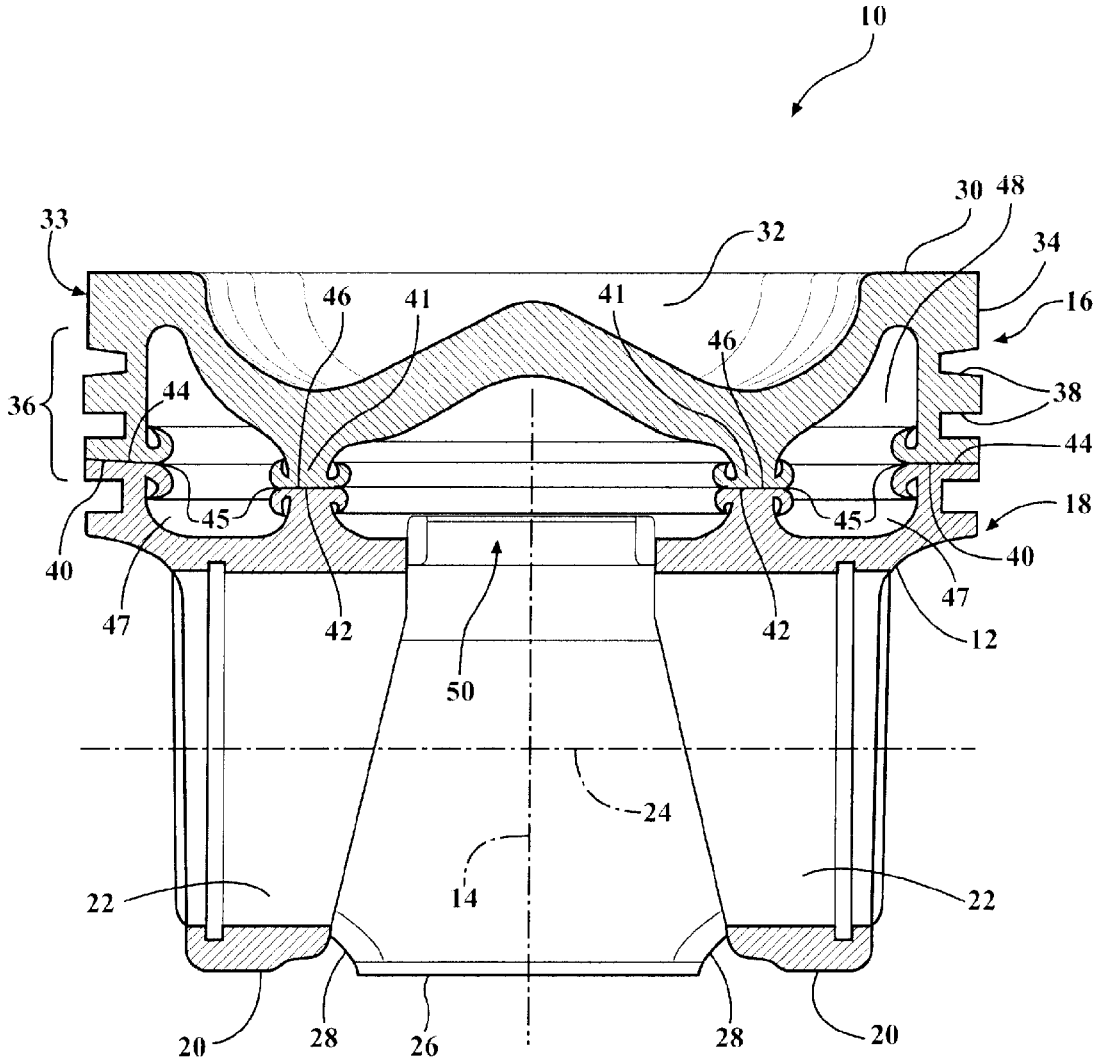
FIG. 2 is a cross-sectional view taken generally along a pin bore axis of the piston of FIG. 1.

Referring in more detail to the drawings, FIGS. 1 and 2 illustrate a piston assembly, referred to hereafter simply as piston 10, constructed according to one presently preferred embodiment of the invention for reciprocating movement in a cylinder bore or chamber (not shown) of a cylinder liner of an internal combustion engine. The piston 10 has piston head, also referred to as piston body 12, either, at least in part, cast or forged, or formed by any other process of manufacture, extending along a central longitudinal axis 14 along which the piston 10 reciprocates in the cylinder bore. The body 12 has an upper crown 16 fixed to a lower crown 18. The lower crown 18 has a pair of pin bosses 20 depending from the upper crown 16 to provide laterally spaced pin bores 22 aligned along a pin bore axis 24 that extends generally transverse to and intersects the central longitudinal axis 14. The pin bosses 20 are joined to laterally spaced skirt portions 26 via strut portions 28. The skirt portions 26 are diametrically spaced from one another across opposite sides the pin bore axis 24 and have convex outer surfaces contoured for cooperation within the cylinder bore for a low friction sliding relation relative thereto to maintain the piston 10 in a desired orientation as it reciprocates within the cylinder bore. The upper crown 16 is constructed as a monolithic piece from a first material having a first thermal conductivity, while the lower crown 18 is constructed from a separate piece from the upper crown 16 from a second material having a second thermal conductivity that is lower than the first thermal conductivity. The first material can be provided as aluminum and the second material can be provided as steel, by way of example and without limitation. As such, the first material has an increased thermal conductivity relative to the second material, wherein the first material is referred to hereafter as having a "high" thermal conductivity and the second material is referred to hereafter as having a "low" thermal conductivity. As such, the upper crown 16 has an increased capacity to transfer heat, such as to underlying, oil circulating with a cooling chamber and radially outwardly to the cylinder liner. Meanwhile, the lower crown 18 has an increased strength and dimensional stability, thereby facilitating smooth, low friction sliding of the piston 10 within the cylinder liner over the useful life of the piston 10.

The upper crown 16 of the piston 10 is represented here as having an upper combustion surface 30 with a combustion bowl 32 recessed therein to provide a desired gas flow within the cylinder bore. An outer wall 33, including an upper land 34 and a ring belt 36, extends downwardly from the upper combustion surface 30 to an annular outer rib having an annular free end 40, with at least one annular ring groove 38 being formed in the ring belt 36 for floating receipt of a piston ring (not shown). An annular inner rib 41 depends from an under surface of the combustion bowl 32 to an annular inner free end 42, wherein the inner rib is shown, by way of example, as extending below the outer free end 40. Thus, the outer wall 33 and the inner rib 41 form an annular upper outer gallery portion 43.

The lower crown 18 is constructed separately from the upper crown 16, such as in a forging process, by way of example and without limitation, and then joined to the upper crown 16 via an upstanding annular outer rib free end 44 and an upstanding annular inner rib free end 46, which form an annular lower outer gallery portion 47. The upper and lower crowns 16, 18 are represented here as being joined together by a friction weld or any other suitable type of weld joint 45 formed across the respective outer free ends 40, 44 and inner free ends 42, 46, for example. As such, a substantially closed outer oil gallery 48 is formed between the upper and lower crowns 16, 18, by the oppositely facing gallery portions 43, 47 while an open inner gallery 50 is formed upwardly of the pin bores 22 beneath a central portion of the combustion bowl 32. It should be recognized that the piston 10, constructed in accordance with the invention, could have upper and lower crown portions formed otherwise, having different configurations of oil galleries, for example. The lower crown 18 is constructed from any suitable first material, such as steel, having a lower thermal conductivity relative to the second material, such as aluminum, of the upper crown 16.

In operation, the upper crown 16, being constructed from the "high" thermal conductivity second material, acts as facilitator to heat transfer to transfer heat readily throughout the upper crown 16 to heat absorbers, such as oil coolant and the cylinder liner. As such, the upper crown 16, and in particular, the region of the upper land 34 acts as a heat transfer agent, thereby dissipating heat within the upper crown 16. As a result of readily transferring heat, carbon build-up is minimized on the upper land 34, and thus, the ring or rings (not shown) disposed in the ring groove 38 are not inhibited from sealing against the cylinder wall. It has been determined that carbon build-up tends to occur generally between about 200-300 degrees Celsius, and that above 300 degrees Celsius the carbon is burned off and thus, does not build up on the upper land 34. Accordingly, by ensuring the upper land has a suitable supply of heat transferred thereto, the upper land 34 remains at or above 300 degrees Celsius, and thus, the build-up of carbon is inhibited.

In accordance with another aspect of the invention, a method of constructing a piston 10 for an internal combustion engine is provided. The method includes forming an upper crown 16 as a monolithic piece of an aluminum material with the upper crown 16 being formed having an upper combustion surface 30 with an upper land 34 depending therefrom. The upper land 34 is formed having a ring belt region including at least annular one ring groove 38 configured for receipt of a piston ring (not shown). The method further includes forming a lower crown 18 from a steel material having a thermal conductivity that is lower than the thermal conductivity of the upper crown 16. Further yet, the method includes forming the lower crown 18 having a pair of pin bosses 20 providing a pair of laterally spaced, axially aligned pin bores 22. Then, fixing the lower crown 18 to the upper crown 16, such as in a welding process, such as a friction weld process, for example, wherein a depending outer wall 33 and a depending inner rib 41 of the upper crown 16 are welded to an upstanding annular outer rib free end 44 and an upstanding annular inner rib free end 46 of the lower crown 18, respectively, to form a substantially closed outer gallery 48.

Figure 3:
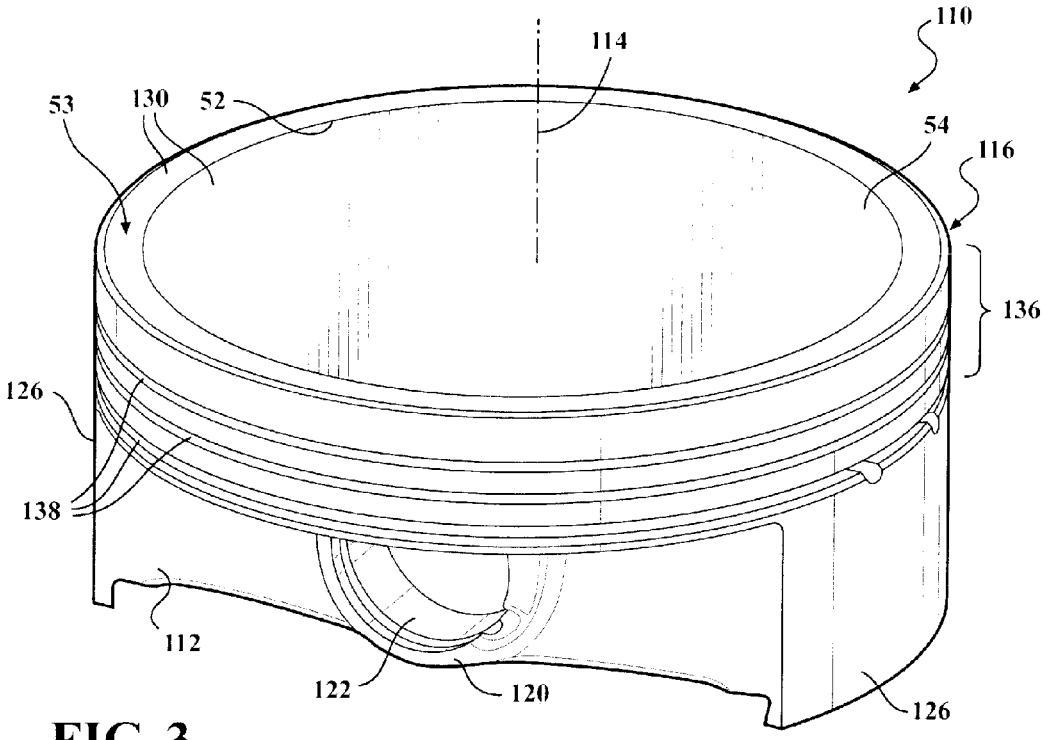
FIG. 3 is a perspective view of a piston constructed in accordance with another aspect of the invention.
Figure 4:
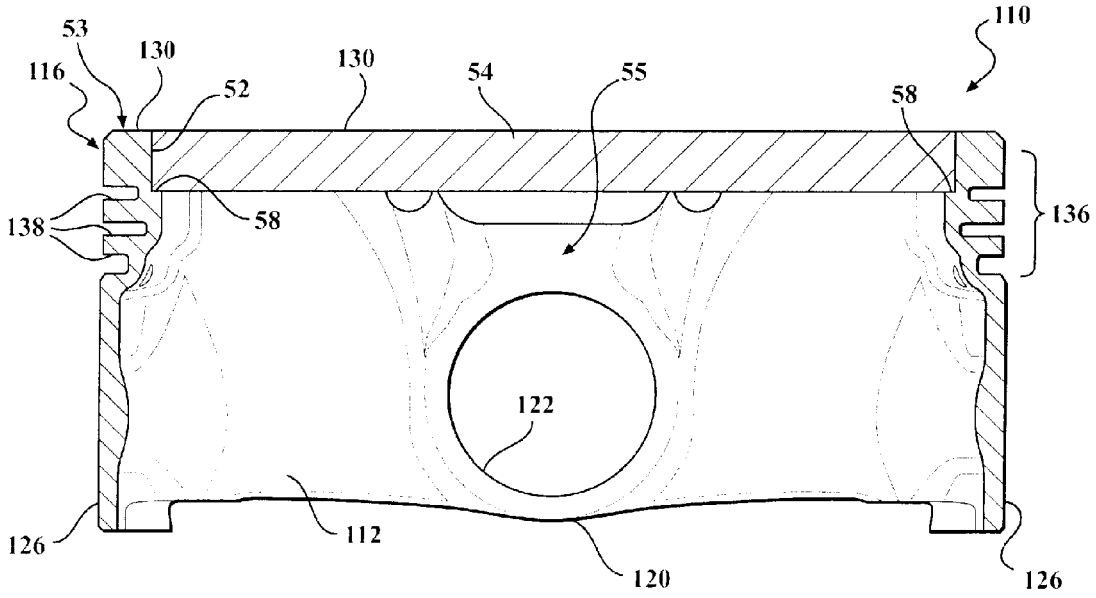
FIG. 4 is a cross-section view of the piston of FIG. 3.
Figure 5:
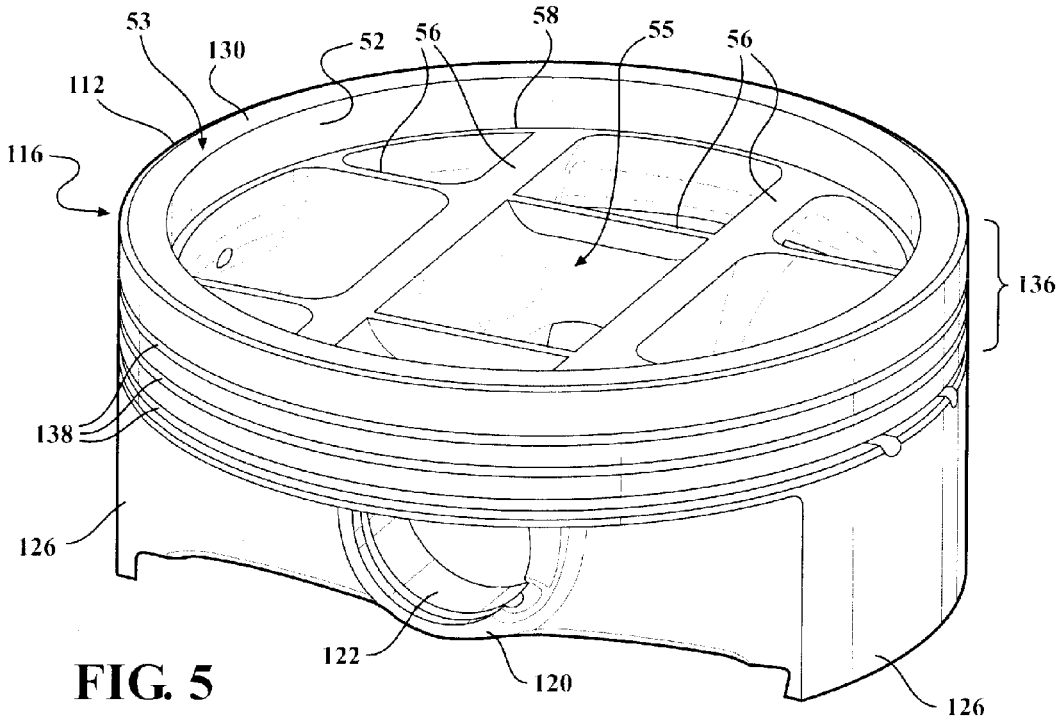
FIG. 5 is a view of a piston head of the piston of FIG. 3 with an upper combustion surface insert removed therefrom.
Figure 6:
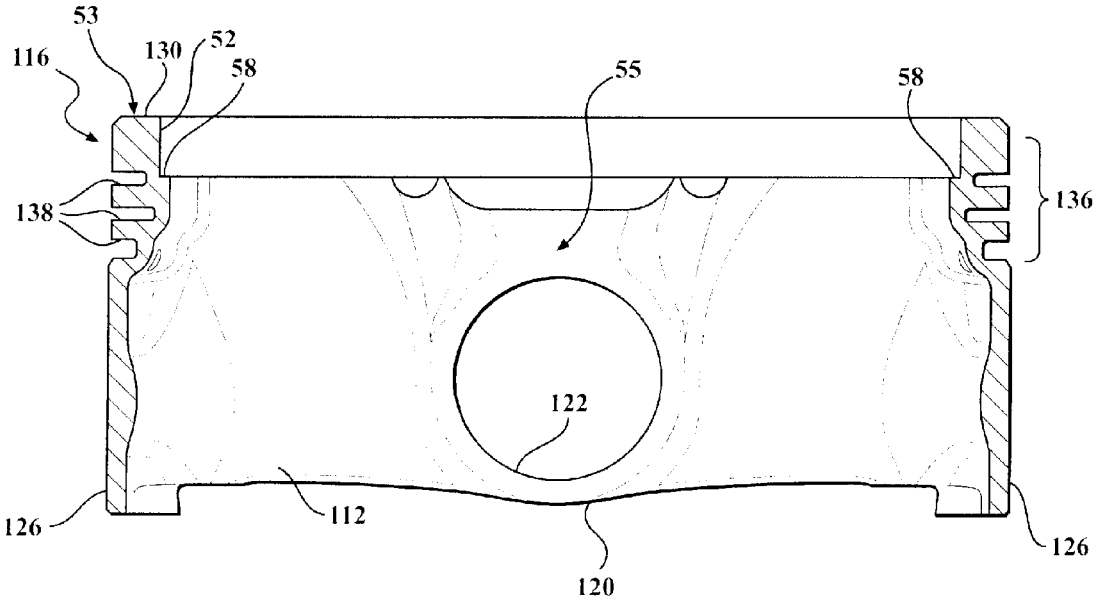
FIG. 6 is a cross-sectional view of the piston head of FIG. 5.

FIG. 3 shows a piston 110 constructed in accordance with another aspect of the invention, wherein the same reference numerals, offset by a factor of 100, are used to identify like features.

The piston 110 includes a piston head, also referred to as piston body or body 112, depending along a longitudinal central axis 114 from an upper combustion surface 130 of an upper crown 116 to a pair of pin bosses 120. The piston body 112 is formed as a monolithic piece of a first material having a first thermal conductivity, such as from steel, by way of example and without limitation. The pin bosses 120 present pin bores 122 aligned with one another along a pin bore axis 124. The piston body 112 has a pair of skirt portions 126 configured for sliding receipt within a cylinder bore of an internal combustion engine. The piston body 112 also has a ring belt 136 having at least one ring groove 138 for receipt of a corresponding piston ring (not shown). The upper crown 116 has a recess 52 formed therein with an insert 54 fixed in the recess 52, wherein the insert 54 forms at least a portion of an upper combustion surface 130, shown as being flat or substantially flat, by way of example and without limitation. The insert 54 is formed from a second material different from the first material, wherein the second material has a second thermal conductivity that is greater than the first thermal conductivity of the piston body 112, wherein the second material can be provided as aluminum, by way of example and without limitation. The insert 54 forms the majority of, and preferably between about 55-100 percent, and in one preferred embodiment, the insert 54 formed about 95 percent of the upper combustion surface 130, with the piston body 112 only forming a relatively small annular band 53 (about 5 percent) of the upper combustion surface 130 along a radially outermost region or outer periphery of the upper combustion surface 130, though it is anticipated that the entire combustion surface 130 can be formed by the insert 54, if desired.

The recess 52 is formed extending into the upper end of the upper crown 116, and is shown as providing a substantially open cavity 55 extending through the piston body 112 with at least one bridge, also referred to as web, and shown as a plurality of webs 56 formed as monolithic pieces of the first material with the piston body 112 extending across the substantially open cavity 55 for abutting support with an underside, also referred to as undercrown, of the insert 54. Accordingly, the underside of the insert 54 is fixed in abutment with the webs 56. The webs 56 are shown as extending in a grid pattern, such that two pair of webs 56 are formed, by way of example and without limitation, with the pairs 56 intersecting one another in generally transverse relation with one another. As such, one pair of the webs 56 extend generally parallel to a pin bore axis 124 on opposite sides of the pin bore axis 124 from one another, while the other pair of webs 56 extend generally transversely to the pin bore axis 124 generally over, and axially aligned, with the pin bosses 120. Accordingly, at least some of the webs 56 extend transversely to one another. In addition to the structural support provided by the webs 56, and annular recessed counterbore, rim or shoulder 58 is also provided for added support about the entire outer circumferential periphery of the insert 54. The shoulder 58 extends about and encircles the webs 56 in planar relation therewith so as to form a planar support surface for abutment with the underside of the insert 54. It is to be recognized that the webs 56 could support the insert 54 without the formation of the rim 58, and vice versa.

Obviously, many modifications and variations of the present invention are possible in light of the above teachings. It is, therefore, to be understood that within the scope of the appended claims, the invention may be practiced otherwise than as specifically described.

What is claimed is:

1. A piston for an internal combustion engine, comprising:

a piston body formed from a first material having a first thermal conductivity and having a pair of pin bosses depending from an upper crown with pin bores aligned with one another along a pin bore axis, said upper crown having a recess, said piston body having a pair of skirt portions diametrically opposite one another, said skirt portions being joined to said pin bosses via strut portions;

an insert formed from a second material separate from said first material, said second material having a second thermal conductivity that is higher than said first conductivity, said insert being fixed in said recess and forming at least part of an upper combustion surface; and further comprising a plurality of webs formed as a monolithic piece of said first material with said piston body, said plurality of webs extending across said recess in abutment with said insert, said plurality of webs including a first pair of webs extending generally parallel with one another and with said pin bore axis and a second pair of webs extending generally transversely to said first pair of webs and intersecting said first pair of webs, said second pair of webs extending upwardly as an extension of said struts, said insert being fixed to a generally planar surface of said first and second webs.

2. The piston of claim 1 wherein said insert forms about 95 percent of said upper combustion surface.

3. The piston of claim 2 wherein said piston body forms an outermost periphery of said upper combustion surface.

4. The piston of claim 1 wherein said recess is formed as a substantially open cavity extending axially through said piston body.

5. The piston of claim 1 further comprising an annular recessed shoulder encircling said at least one web, said recessed shoulder and said at least one web forming a planar surface abutting said insert.

6. The piston of claim 1 wherein a ring belt region having at least one ring groove extending radially therein is formed in said piston body.

7. The piston of claim 1 wherein said first material is steel.

8. The piston of claim 7 wherein said second material is aluminum.

9. The piston of claim 1 wherein said second material is aluminum.

10. A method of constructing a piston, comprising:

providing a piston body constructed from a first material having a first thermal conductivity, with the piston body having a pair of pin bosses depending from an upper crown with pin bores aligned with one another along a pin bore axis, the upper crown having a recess; and providing an insert constructed from a second material having a second thermal conductivity that is greater than the first thermal conductivity of the piston body; and fixing the insert in the recess with the insert forming at least a portion of the upper combustion surface of the piston.

11. The method of claim 10 further including forming about 95 percent of the upper combustion surface with the insert.

12. The method of claim 11 further including forming an outermost periphery of the upper combustion surface with the piston body.

13. The piston of claim 10 further including forming the recess as a substantially open cavity extending axially through the piston body.

14. The method of claim 13 further including providing the piston body with at least one web extending across the cavity and fixing the insert in abutment with the at least one web.

15. The method of claim 14 further including providing the piston body with a plurality of the webs.

16. The method of claim 15 further including providing the plurality of webs extending transversely with one another.

17. The method of claim 14 further including providing the piston body with an annular recessed shoulder encircling the at least one web and fixing the insert in abutment with the recessed shoulder and the at least one web.

18. The method of claim 10 further including providing the piston body with a ring belt region having at least one ring groove extending radially therein.

19. The method of claim 10 further including providing the first material as steel.

20. The method of claim 19 further including providing the second material as aluminum.

21. The method of claim 10 further including providing the second material as aluminum.

* * * * *